United States Patent [19]

Boyd, Jr.

[11] Patent Number: 4,901,439

[45] Date of Patent: Feb. 20, 1990

[54] LOCK BLOCK KNIFE WITH SINGLE LOCK POSITION

[75] Inventor: Francis M. Boyd, Jr., San Francisco, Calif.

[73] Assignee: F. Boyd, Ltd., a California Limited Partnership, San Francisco, Calif.

[21] Appl. No.: 345,432

[22] Filed: May 1, 1989

[51] Int. Cl.[4] ..... B26B 1/04

[52] U.S. Cl. ..... 30/161

[58] Field of Search ..... 30/159–161; 81/177 E; 16/110 R, 110.5; 7/118–120

[56] References Cited

U.S. PATENT DOCUMENTS

| | | | |
|---|---|---|---|
| 3,942,249 | 3/1976 | Poehlmann | 30/161 X |
| 4,170,061 | 10/1979 | Henry | 30/160 |
| 4,541,175 | 9/1985 | Boyd et al. | 30/161 |
| 4,670,984 | 6/1987 | Richard | 30/161 |

*Primary Examiner*—Douglas D. Watts

*Attorney, Agent, or Firm*—Frank L. Zugelter

[57] ABSTRACT

A foldable knife (20) having a mechanism (29) which locks its blade (21) in open position but not in its closed position within a pocket (27) formed in its sheath (22). Mechanism (30) is mounted at a pivot axis for the rotation of sheath (22) to blade (21), and comprises a body (31) eccentrically mounted to an axle (30), the block body (31) being releasably slidable into either an opening (44) formed in the thickness of blade (23) or into a position straddling opening (45) and a cavity (44) formed in handle side (23). When so straddled, the blade is locked in open position. A pin (38) mounted on axle (30) is depressed against the biasing of a spring (39) mounted to the other side of block body (31), to push it from its straddling position, so that it slides into the thickness of blade (21), whereby sheath (22) of knife (20) is rotatable about blade (21) to place the latter in its pocket (27). An alternative embodiment includes two blades (51a, 51b) in one sheath and separated by a leaf (57), operable in a similar manner.

14 Claims, 3 Drawing Sheets

LOCK BLOCK KNIFE WITH SINGLE LOCK POSITION

TECHNICAL FIELD

The present invention relates to folding blade knives, and more particularly relates to an improved single-lock-position in the open mode for the blade while there is no locked position for the blade in its closed mode or sheath, and the assembly by which this is accomplished.

BACKGROUND ART

My two (2) issued Letters Pat. No. 4,542,175, granted Sept. 17, 1985, and 4,750,267, granted June 14, 1988 disclose similar knives, however, they do not disclose or claim the present invention.

DISCLOSURE OF THE INVENTION

The subject matter of the invention comprises a knive blade foldable about its sheath, the blade pivoting from an open or locked position to a closed or unlocked position within its sheath or side handles, or vice versa. An assembly or mechanism is mounted about the blade's pivot axis to accomplish this effect and comprises a square or polygonal block on which is mounted an axle projecting from both of its sides, the block being eccentrically mounted to the axle. The block body seats in a cavity in one of the side handles and an opening in the tang of the knive blade when the blade is in its open and locked position, thereby locked from pivoting. In the closed or unlocked position for the blade within its sheath or handles, the block is seated only in the tang's opening and is offset from such cavity, and thus free to rotate or pivot with the blade on the axle. Biasing means, such as a spring, is mounted to the axle to the side of the block opposite the side adjacent the cavity, while a depressable pin is preferably mounted on the axle to the side of the block facing the cavity, the axle being journalled in the side handles forming the sheath. The pin is pushed against the action of the spring in order to release the block from being seated in both the cavity and the tang's opening, so that the block slides into the thickness of the tang. The handle then can be rotated about the blade to bring the latter into the sheath. An alternative embodiment provides for a pair or plurality of blades of which one or the other or both can be locked in open position at a time, using such an assembly or mechanism.

An object of this invention is to provide a novel foldable knife.

Another object of this invention is to produce an action in a foldable knife whereby the blade is locked in opened position relative to its sheath but not locked in its closed position in its sheath.

These and other objects and advantages of this invention will become more apparent upon a complete reading of the following description, the appended claims thereto and the accompanying drawing comprising three (3) sheets of twelve (12) FIGURES.

BEST MODES FOR CARRYING OUT THE INVENTION

Figure 1:
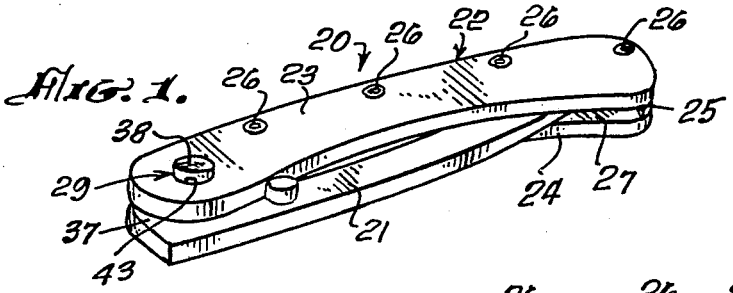
FIG. 1 is a perspective view of the knife with blade in its sheath or closed position.
Figure 2:
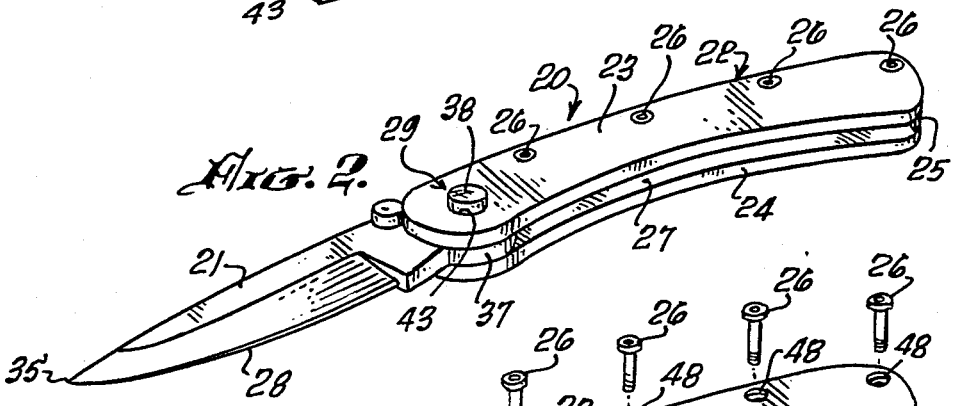
FIG. 2 is a perspective view of the knive with the blade in its open or locked position.
Figure 3A:
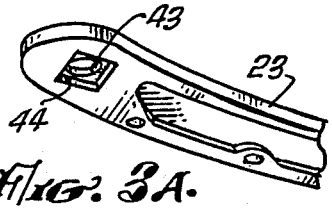
FIG. 3A is a fragmentary perspective view of the underside of the upper handle shown in FIG. 3.
Figure 3:
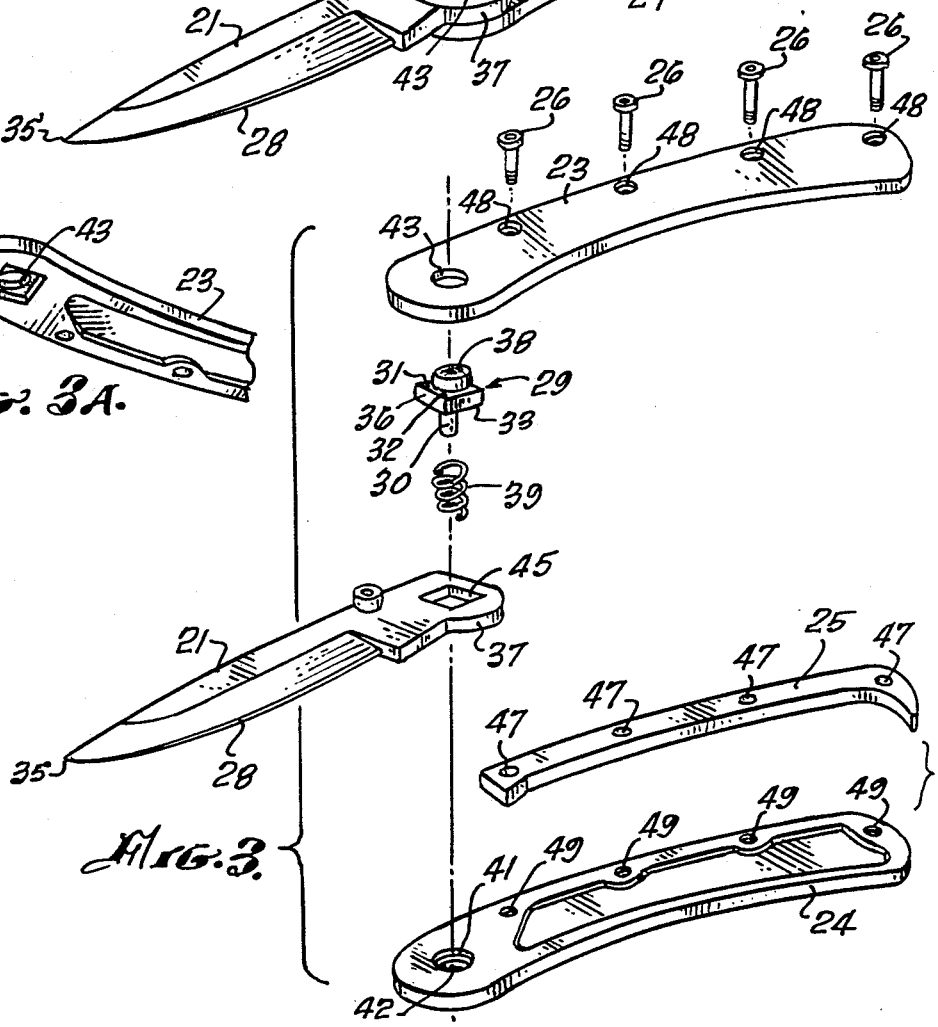
FIG. 3 is an exploded perspective view of the subject matter of the invention.

Referring now to the drawing wherein reference numerals therein correspond to like numerals hereinafter, FIGS. 1–3 illustrate the invention embodied in a foldable knife 20 comprising a blade 21 pivotally mounted to its sheath 22 which includes a pair of plates or handle sides 23, 24, spaced from one another by means of a spacer bar 25, FIG. 3. A plurality of Allen-head screws 26 secure together sides 23, 24 and spacer bar 25, while forming a pocket 27, FIG. 2, within sheath 22 and in which pocket 27 cutting edge 28 of blade 21 is disposed when the knive is in its closed position. Sheath 22 pivots about blade 21, from a closed position to an opened position, and visa versa, it being locked in its open position and it being unlocked in closed position in pocket 27, as the following description will make more apparent.

A square lock block assembly or mechanism 29 is utilized to accomplish this single-lock position effect. Mechanism 29 comprises, FIGS. 3–8, an axle 30, a block body 31 mounted on axle 30, the axle extending through its body and projecting outside of each of its sides 32, 33. Block body 31 and axle 30 are eccentrically mounted to one another such that the pivot axis of axle 30 is closer to an edge 34, FIGS. 4, 6, of body 31 which is proximal to the tip 35 of blade 21 than to its opposing edge 36 which is distal to tip 35. The thickness of body 31 is represented by all of its edges, including edges 34, 36, which are equated to the thickness of a tang 37 formed at an end of blade 21 opposing its tip 35. Preferably included in axle 30 is a pin or button 38 which is of a size greater than that of axle 30 to facilitate the operation of the invention, as will become more apparent hereinafter. Pin 38 projects outwardly from side 32 while axle 30 projects from both sides 32, 33. A spring 39 is mounted about axle 30, its one end seated in an annular groove 40, FIG. 7, formed in block body 31, its other end being seated in a circular recess 41, FIG. 7, formed in the one handle side 24. A hole 42 is formed centrally within circular recess 41 in handle side 24 to support and function as a journal for the end of axle 30 which extends thereinto. Pin 38 in turn is journalled in an aperture 43 formed in the other handle side 23, and as indicated by the arrow in FIG. 8, is utilized for finger or thumb manipulation of block 31 in operation of the invention.

Figures 4, 5, 6, 7, 8:
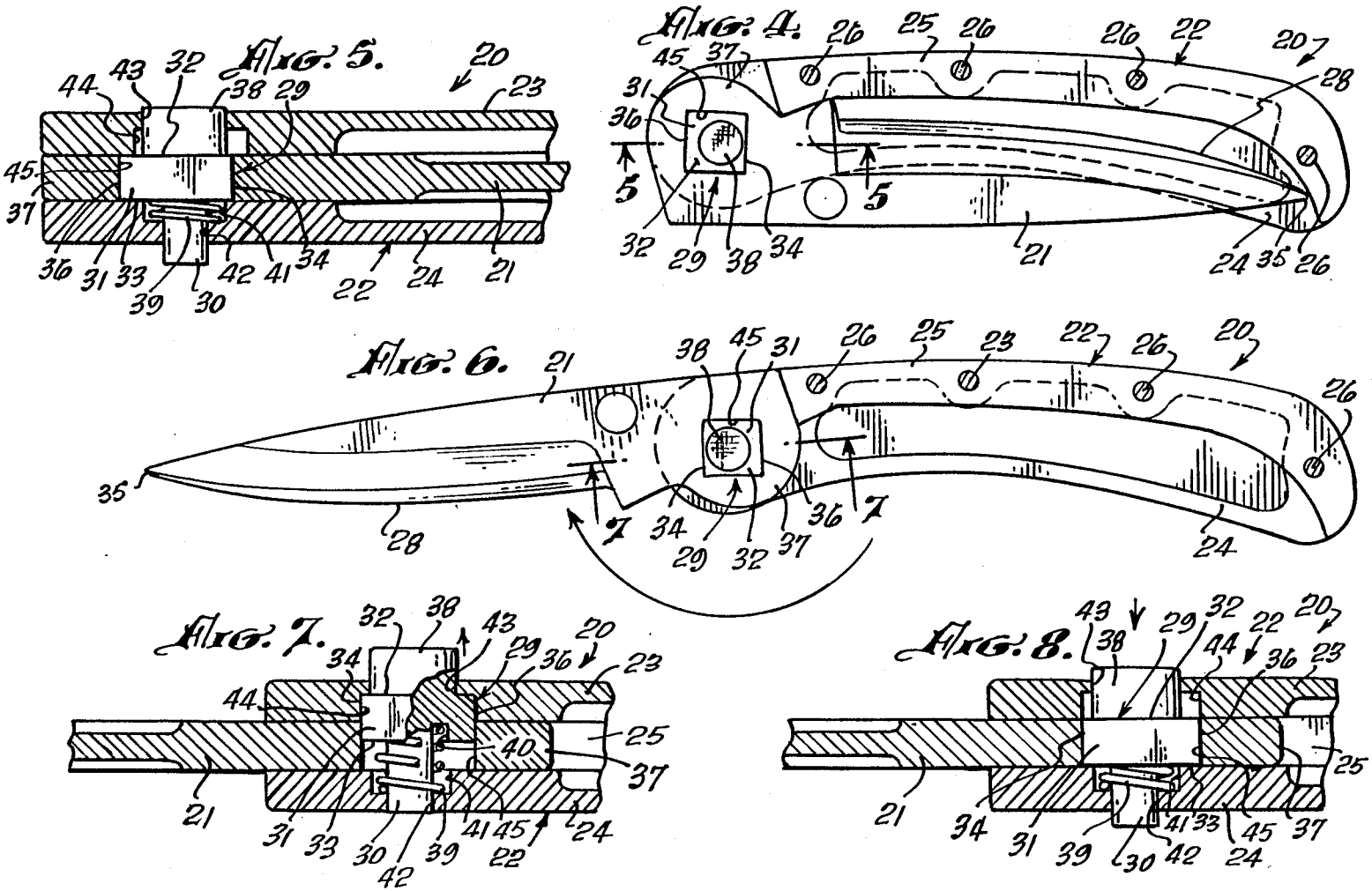
FIG. 4 is a side view of the knife with one handle removed so that the blade itself is shown in full line in its closed position.
FIG. 5 is a view taken on line 5—5 of FIG. 4.
FIG. 6 is an open-position view for the blade of FIG. 4.
FIG. 7 is a view taken on line 7—7 of FIG. 6.
FIG. 8 is a modified view of FIG. 7, showing the assembly mechanism in a position for free pivoting for blade between its open and sheath positions.

A cavity 44, FIGS. 3A, 5, is formed about aperture 43 from the interior face of handle side 23, and an opening 45 is formed in tang 37 of blade 21 to face cavity 44. Cavity 44 and opening 45 correspond in configuration and size to block body 32 so that the latter is releasably slidable into either the blade's thickness constituting such opening 45, or half of its thickness into cavity 44 while its other half remains in opening 45. It is to be noted that in the closed position for blade 21, FIG. 5, opening 45 in which body 31 is captured is offset in relation to cavity 44. However, when blade 21 is in its open position, FIG. 7, block body 32 seats in both cavity 44 and opening 45 which are in registration and with one another by reason of the action of spring 39, and is locked in such open position. The eccentricity between axle 30 and block body 31 provides for such offset between cavity and opening and for the registering or mating of them in the operation of the invention.

In operation, wherein initially blade 21 is disposed in its closed postion in pocket 27, sheath 22 is pivoted about axle 30 so that blade 21 rotates into its open position, FIG. 2. In the blade's closed position, block body 31 lies within opening 45, within the thickness of tang 37, and is in its offset position relative to cavity 47 in handle side 23, thus not slidable thereinto. As the pivoting takes place, such offset is eliminated by the eccentric rotation of the block body which snaps into cavity 47 as such offset is eliminated and registration or mating occurs, the action of biasing spring 39 assuring this to be the case. FIG. 7 illustrates the locked position of the blade in its opened position, wherein block body 29 straddles both the cavity 47 in handle side 23 and opening 45 in blade 21 itself.

In reversing this operation, i.e., to put the blade into its closed position, pin or bottom 38 is depressed, FIG. 8, such as by a thumb, against the force of spring 39, to releasably slide or move block body 31 into opening 45 and the thickness of tang 37. Thus, sheath 22 now is pivotable about axis 30 so that blade 21 can return to its closed position within pocket 27, cavity 47 and opening 45 becoming offset inn relation to each other in the process.

To assemble knife 20 (with block, axle and button preferably integrally formed), block body 31 is mounted into opening 45 in tang 37 of blade 21 so that it along with button 38 then can be mounted to aperture 43 in the one handle side 23, with blade 21 in its open position and body 31 seating in cavity 44. Spring 39 is mounted to axle 30. Spacer bar 24 is mounted to handle side 23, matching its holes 47 with corresponding holes 48 in handle side 23. Thereafter handle side 24 is mounted to spacer bar 25 with its hole 42 mounted over axle 30, and spring 39 seating in recess 41. Allen-screws 26 are inserted through their corresponding holes 48 in side handle 23, to be threaded to their corresponding threaded holes 49 in handle side 24. Thereafter, sheath 22 is readily pivotable axle 30 so as to dispose blade 21 in its pocket 27.

The materials forming the above described elements are of the usual or conventional type. The blades are of stainless steel or other suitable rigid material, including plastic and wood, to which a cutting edge can be honed. The handle sides are formed of brass, the Allen screws are of known metal material. The metal block, with its axis, button, groove and recess, is machined out of suitable metal or other suitable materials. The spring is conventionally produced. Spacer bar 25 is made of stainless steel or other suitable material.

Figures 9, 10, 11:
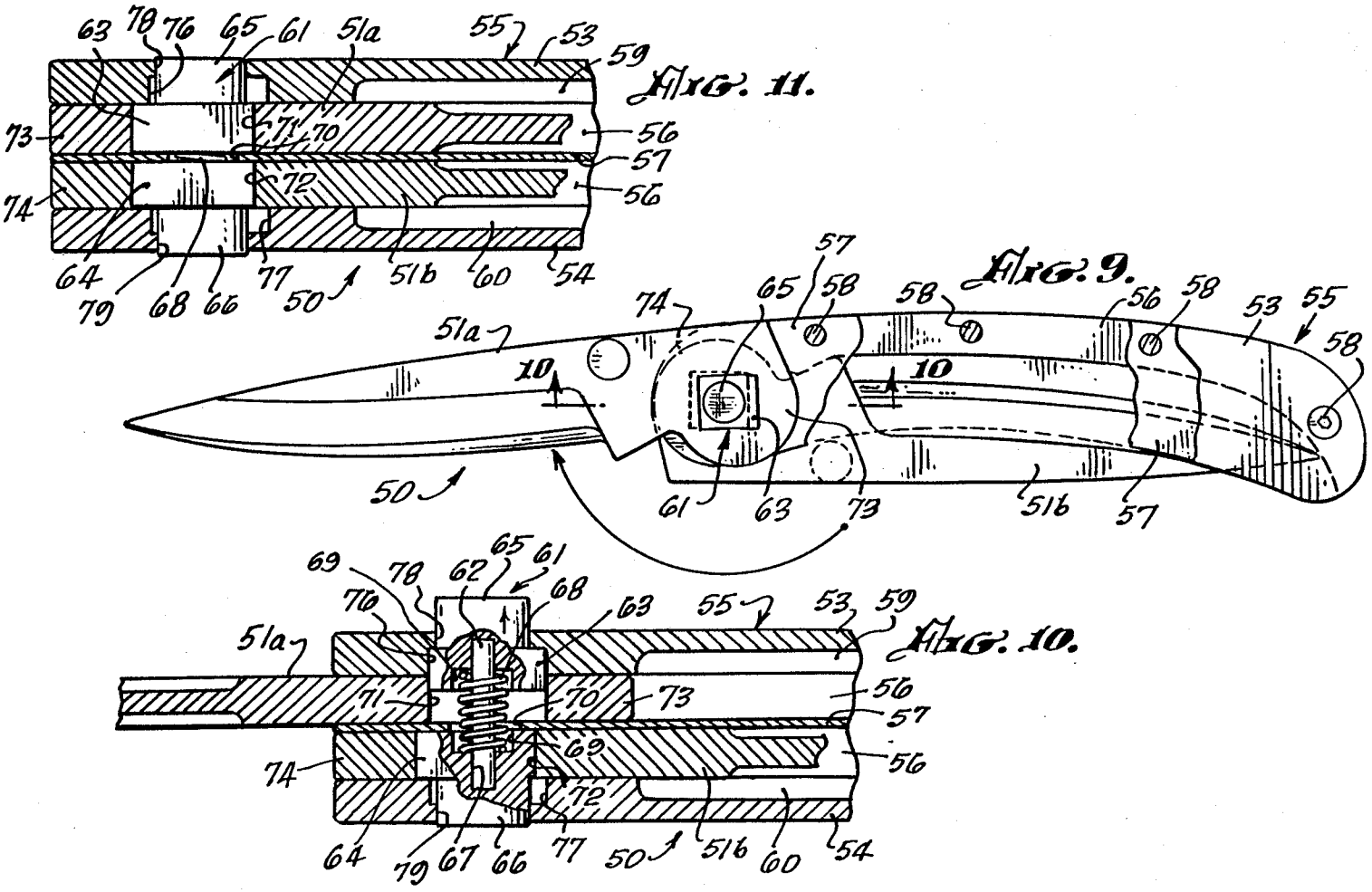
FIG. 9 is a side view of another embodiment of the invention, illustrating a double bladed knife, with one blade in open and locked position while the other blade is in closed and unlocked position.
FIG. 10 is a view taken on line 10—10 of FIG. 9.
FIG. 11 is a modified view of FIG. 10, showing the assembly or mechanism in a position by which free pivoting for the blades between open and sheath positions may occur.

Referring now to the embodiment illustrated in FIGS. 9–11, a knife 50 comprises a pair of adjacently disposed blades **51*a*, 51*b* pivotally mounted to handle sides 53, 54 forming a sheath 55. Sides 53, 54 are spaced apart from one another by a pair of spacer bars 56, FIG. 10 (one of which only is shown in FIG. 9), and a divider leaf 57 directly separating the adjacent blades 51*a*, 51*b* themselves. One facing wall of each of the spacer bars 56 engages a corresponding face of leaf 57. Handle sides 53, 54, spacer bars 56 and leaf 57 are all secured in the assembly of knife 50 by means of screws 58 mounted and threaded in holes intermittently spaced along the lengths of the sides and bars, in the same manner as described with reference to the screws and holes of the embodiment in FIGS. 1–8, the screws 58 being threaded to corrresponding threaded holes in handle side 54, thus producing corresponding pockets 59, 60, FIG. 10, for the blades in closed position. FIGS. 9 and 10 illustrate one blade 51*a* in open and locked position, while FIG. 11 illustrates both blades 51*a*, 51*b* in closed and unlocked position in their pockets 59, 60 and sheath 55**.

An assembly or mechanism 61 provides for the pivoting, locking and unlocking actions for the blades. Assembly 61 comprises, FIG. 10, an axle 62, a pair of block bodies 63, 64 each mounted eccentrically on and from opposing ends of axle 62, and push buttons 65, 66, similar to that of button 38, FIG. 7, mounted to bodies 63, 64, respectively. A bore 67 is located in each block body 63, 64 such that they are eccentrically mounted to axle 62, as illustrated in FIG. 10. A spring 68 is mounted to axle 62, between the facing walls of bodies 63, 64, to provide a force which tends to maintain block bodies 62, 64 apart from one another as such force is applied to these bodies. It is to be noted that each of block bodies 63, 64 includes annular grooves 69, FIG. 10, so that the ends of spring 68 seat therein. An orifice 70 is formed in divider leaf 57 for passage of axle and spring between such bodies, however, it is to be noted that it also functions to prevent contact of bodies 63, 64 with one another or for such bodies to pass through orifice 69 to interfere with the action of the other block body.

Openings 71, 72 are formed in tangs 73, 74, respectively, of the blades **51*a*, 51*b* for disposition of block bodies 62, 64, respectively, when the blades are in closed position, FIG. 11, leaf 57 preventing the passage of each block body into the opening provided for the other block body. To be retained fully in their corresponding openings 71, 72, against the force of compressed spring 68, both block bodies 63, 64 are offset in relation to their corresponding or associated cavities 76, 77 formed in the handle sides 53, 54, FIG. 11, in the same manner as was described in reference to the embodiment of FIGS. 1–8. Also, suitable apertures 78, 79 are provided in plates or handle sides 53, 54 for projection therethrough of buttons 65, 66, respectively, in the same manner and for the same function as is illustrated by button 38** in the described embodiment of FIGS. 1–8.

FIGS. 9 and 10 illustrate block body 63 straddling its opening 71 in tang 73 and cavity 76 in handle side 53 to lock blade **51*a* in its open position, while block body 64 remains within opening 72 of tang 74 against the force of a less compressed spring portion because of its offset location to cavity 77. Blade 51*b* may just as easily be pivoted or rotated into its open position, with its block body 64 straddling opening 72 in tang 74 and cavity 77 in side handle 54, without interference from or interfering with the pivotal operation of the other blade 51***a*. However, in normal use of knife 50, only one blade would be open from sheath 55 at a time by means of depressing its associated button 65 or 66. In other words, each button is independently operable relative to the other.

In assembly of the embodiment of FIGS. 9–11, with a blade disposed for open position, a block body inserted in the tang's opening of such blade is mounted with the blade to a plate or handle side's cavity. Axle 62 is mounted to such body, spring 68 then mounted to the axle and into an annular groove 69, with spacer bar and divider leaf then put into their respective places. Thereafter, the next block mounted in the opening of its blade (disposed for open position) is located to the divider leaf, after which the next spacer bar and handle side or plate are mounted in place. Threaded screws then are applied accordingly, to secure together with the knife's components.

The divider leaf is preferably of brass, while the materials of the other elements are the same as those in the FIGS. 1–8 embodiment.

In operation, initially both blades 51*a*, 51*b* are in closed position, as illustrated by FIG. 11, wherein block bodies 63, 64 are fully retained within openings 71, 72 of their respective tangs 73, 74 by reason of the offset of such bodies to their corresponding cavities 76, 77 in handle sides 53, 54. Either one or both of the knife blades may be pivoted about the axis for axle 62, and thereby become locked in open position, by the straddling of either or both block bodies between their corresponding tang openings and side handle cavities. FIG. 10 shows such a condition with but one knife in its open and locked position. Reversing this operation, with one or both blades in open locked position, the corresponding one or both buttons 65, 66 are depressed against the bias of spring 68, to slidably release the corresponding block body or bodies from its or their straddling position(s) and into the corresponding opening(s) of the tang(s), so that pivoting of the blade(s) to closed position(s) can be accomplished manually.

Various changes and modifications may be made without departing from the scope or spirit of the invention. A polygonally-shaped block body, other than a square, may be used. One block body may be square, the other polygonal in the FIGS. 9–12 embodiment. The blade or other tool need not be locked in a substantially 180° relationship relative to its sheath, but rather be locked at a different angle thereto, and also then be considered in an open position as well. The orientation of eccentricity of body to axle need not favor the tip of the blade(s), but rather may favor the tang of the blade(s), with corresponding change(s) in the location(s) of the cavity or cavities 76, 77. Axle 30 may be a separate pin press fit to block body 31, rather than integrally formed with a block body. Axle or pin 62, FIG. 10, is preferably a separate member. Also, the springs are mountable interiorly of axle 62 as well as exteriorly thereto, in accordance with disclosure in U.S. Letters Patent #4,740,267.

INDUSTRIAL APPLICABILITY

Knives 20 and 50 are suitable for hand use, such as chipping away on wood, or slicing cardboard or other sliceable material, or used for hunting purposes, and other known purposes to which hand-held knives are usually put, although the invention is not necessarily limited to uses generally associated therewith.

I claim:

1. In a knife having a blade with tang pivotable about an axis and including handle sides forming a pocket into which the blade is pivotable about such axis into a closed position from an open position, an axle on such axis journalled in said handle sides, a block body mounted on said axle, a cavity formed in one of said handle sides, an opening formed in said tang corresponding in size and configuration to such cavity, said block releasably slidable between such opening and cavity only when the blade is in its open position, and means mounted to said axle for biasing said block body, the action of said biasing means always towards said cavity, the improvement comprising said block body being eccentrically mounted to said axle so that it is offset to such cavity in the blade's closed position and it straddles both cavity and opening in the blade's open position, thus locking the blade only in open position.

2. The improvement of claim 1 wherein said block body is configured in a square, the opening and cavity also configured in corresponding and cooperating squares.

3. The improvement of claim 1 or claim 2 including a button mounted on said axle for manipulating the block body from its straddling position between cavity and opening into the opening.

4. The improvement of claim 3 wherein said biasing means comprises a coiled spring mounted to said axle.

5. The improvement of claim 1 or claim 2 wherein said biasing means comprises a coiled spring mounted to said axle.

6. A knife apparatus having at least two blades having tangs with openings therein pivotable about the same axis to and from open locked and closed unlocked positions.

said knife including handle sides having cavities and forming a sheath with pockets one for each blade, said cavities in alignment with such axis, an axle journalled in openings said sides, said axis within said axle, each of in said sides openings being offset to a corresponding one of said cavities in a corresponding one of said handle sides when its corresponding tang is in closed position, at least a pair of block bodies each eccentrically mounted to said axle, each of said bodies retained fully in a corresponding one of said openings in a corresponding one of the tangs when in closed position, means mounted to said axle for biasing said bodies towards their corresponding handle sides, any of said block bodies being releasably slidable against the bias of said biasing means from a straddled position between its corresponding cavity and opening to its corresponding opening whereby its corresponding blade is pivotable into a corresponding one of said pockets.

7. The apparatus of claim 6 wherein each of said block bodies is configured in a square, said openings and cavities also configured in corresponding and cooperating squares.

8. The apparatus of claim 6 or claim 7 including at least one button mounted on one of said block bodies and projecting through a corresponding handle side for manipulating said one of said block bodies from its straddling position between its corresponding cavity and opening into the opening.

9. The apparatus of claim 6 or claim 7 including means for preventing interference of sliding motion of one of said block bodies with the sliding motion of another of said block bodies.

10. The apparatus of claim 9 wherein said preventing means comprises a leaf mounted in the sheath between said tangs and having an orifice therethrough for passage of said axle.

11. The apparatus of claim 7 including means for preventing interference of sliding motion of one of said block bodies with the sliding motion of another of said block bodies.

12. The apparatus of claim 11 wherein said preventing means comprises a leaf mounted in the sheath between said tangs and having an orifice therethrough for passage of said axle.

13. The apparatus of claim 8 including means for preventing interference of sliding motion of one of said block bodies with the sliding motion of another of said block bodies.

14. The apparatus of claim 13 wherein said preventing means comprises a leaf mounted in the sheath between said tangs and having an orifice therethrough for passage of said axle.

* * * * *

UNITED STATES PATENT AND TRADEMARK OFFICE

CERTIFICATE OF CORRECTION

PATENT NO. : 4,901,439

DATED : Feb. 20, 1990

INVENTOR(S) : Francis M. Boyd, Jr.

It is certified that error appears in the above-identified patent and that said Letters Patent is hereby corrected as shown below:

In column 6, line 37, the period (.) is to be read as a comma (,) .

In column 6, line 41, - - in - - is to be read after "openings" .

In column 6, line 43 is to be read as follows: - - each of said openings in said sides being offset to a corre- - -.

Signed and Sealed this

Ninth Day of July, 1991

*Attest:*

*Attesting Officer*

HARRY F. MANBECK, JR.

*Commissioner of Patents and Trademarks*